United States Patent [19]

Flinn

[11] Patent Number: 4,893,801

[45] Date of Patent: Jan. 16, 1990

[54] CLAMP

[76] Inventor: Robert W. Flinn, 2806 Balmoral Ct., Fort Collins, Colo. 80525

[21] Appl. No.: 285,210

[22] Filed: Dec. 16, 1988

[51] Int. Cl.[4] ..... B25B 5/02

[52] U.S. Cl. ..... 269/6; 269/214

[58] Field of Search ..... 269/6, 212–215, 269/216, 143, 249; 254/108–111, 68–72

[56] References Cited

U.S. PATENT DOCUMENTS

| | | | |
|---|---|---|---|
| 829,612 | 8/1906 | Vuillemot . | |
| 996,462 | 6/1911 | Curtis . | |
| 1,196,703 | 8/1916 | Kraut . | |
| 1,400,297 | 12/1921 | Brant et al. . | |
| 1,542,307 | 6/1925 | Kennedy . | |
| 2,124,039 | 7/1938 | Mitchell et al. . | |
| 2,589,075 | 3/1952 | Gravis . | |
| 2,682,239 | 6/1954 | Klema et al. | 269/283 |
| 3,261,242 | 7/1966 | Peters . | |
| 4,220,322 | 9/1980 | Hobday | 269/6 |
| 4,341,375 | 7/1982 | Romanin | 269/253 |

FOREIGN PATENT DOCUMENTS 10410 of 1907 United Kingdom .

*Primary Examiner*—Robert C. Watson

*Attorney, Agent, or Firm*—Dean P. Edmundson

[57] ABSTRACT

A hand-held clamp is described which is operable by one hand. The clamp includes a stationary jaw and a movable jaw carried on elongated support arms. A pressure arm is attached to the movable jaw and is advanced by a ratchet mechanism operated by the hand holding the clamp.

15 Claims, 2 Drawing Sheets

CLAMP

FIELD OF THE INVENTION

This invention relates to clamps. More particularly, this invention relates to clamps of the type having a stationary jaw and a movable jaw. Even more particularly, this invention relates to manually operated clamps.

BACKGROUND OF THE INVENTION

Clamps of various types have been available for a very long time and are used in any application where it is necessary to hold two or more objects together, either temporarily or permanently. A common problem associated with the use of manual clamps is that two hands are normally required in order to tighten the clamp. This is extremely inconvenient or even impossible in certain situations where one hand is also required to hold one or more of the objects to be clamped.

Thus, the assistance of another person is sometimes required in order to properly position and hold the objects while the clamp is operated. Alternatively, it may sometimes be necessary to use a fixture or vise or other temporary holding device to retain the objects in position so that the desired clamp can be used. This is cumbersome, however, and also time consuming.

There has not heretofore been provided a clamp which is operable by one hand and which is convenient and efficient to use in clamping two or more objects together. Various types of tools have been previously described which involve a moving jaw, but none of such tools are adequate for clamping objects together as required herein. See, for example, U.S. Pat. Nos. 829,612; 996,462; 1,196,703; 1,400,297; 1,542,307; 2,124,039; 2,589,075; and 3,261,242. See also British Patent 10,410.

SUMMARY OF THE PRESENT INVENTION

In accordance with the present invention there is provided a manually operated clamp having a movable jaw and a stationary jaw. The clamp is hand-held and can be tightened with one hand, thereby allowing the other hand to be used for temporarily holding or supporting one or more of the objects to be clamped together.

The clamp comprises:

(a) elongated support means having first and second ends;

(b) a base member secured to the first end of the support means;

(c) handle means carried by the base member, the handle means including a movable lever arm;

(d) a stationary jaw member secured to the second end of the support means;

(e) a movable jaw member supported by the support means and being movable therealong;

(f) an elongated pressure arm having first and second ends, the second end being attached to the movable jaw member; wherein the pressure arm extends through the base member;

(g) advance means carried by the base member and being operable by the lever arm; the advance means being adapted to advance the pressure arm through the base member in a manner such that the movable jaw member is advanced toward the stationary jaw member; and (h) releasable catch means carried by the base member for preventing rearward movement of the pressure arm.

The clamp of the invention is easily operated in order to clamp a variety of objects together in an expeditious manner. The clamp can also be easily loosened when desired.

Other advantages of the clamp of this invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
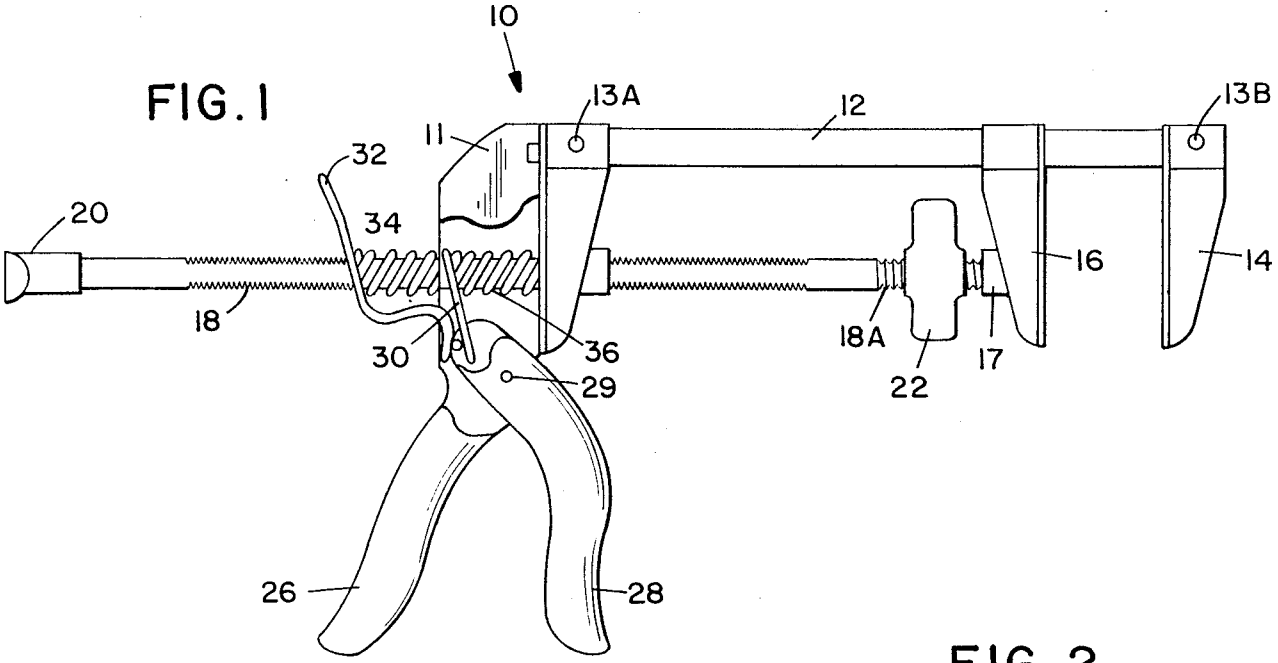
FIG. 1 is a partial cut-away side elevational view of a preferred embodiment of clamp of the invention.
Figure 2:
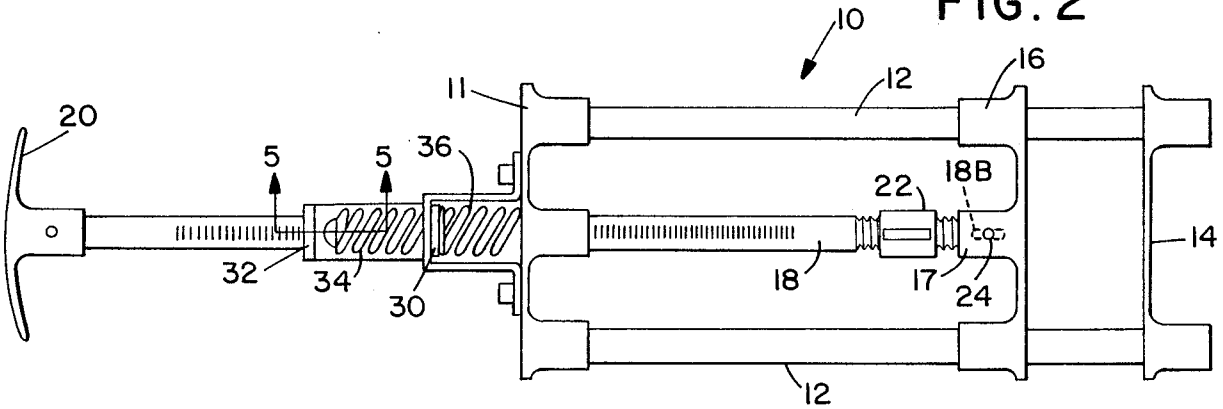
FIG. 2 is a top view of the clamp shown in FIG. 1.

In the drawings there is illustrated a preferred embodiment of hand-held clamp 10 of the invention. The clamp includes elongated support means preferably comprising parallel, spaced-apart support arms 12 attached at one of their ends to base member 11.

Secured to the outer ends of the support arms 12 is a stationary jaw 14 which preferably extends downwardly from the arms, as illustrated. A movable jaw 16 is also carried by the arms 12. Preferably the upper portion of jaw 16 includes tubular openings therethrough which allow the support arms 12 to pass through. The tubular openings in jaw 16 are sufficiently larger than the diameter of arms 12 that the jaw does not bind on the arms when it is moved along the arms.

Figure 4:
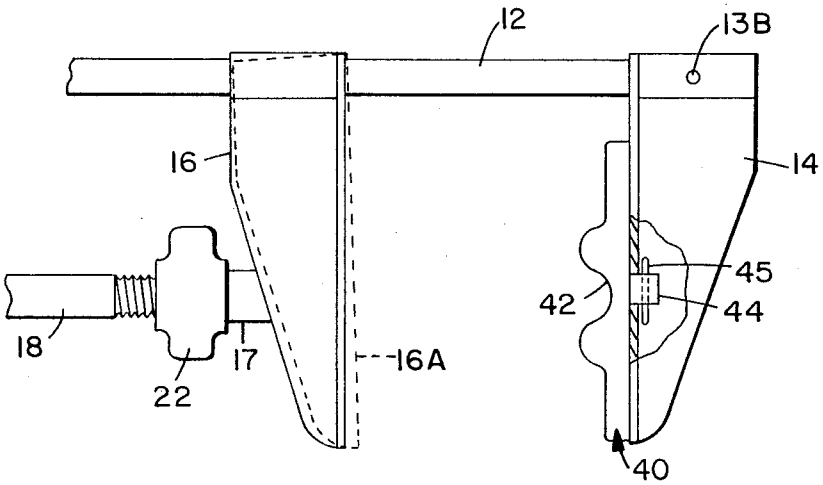
FIG. 4 is a side elevational view illustrating other features of the clamp of the invention.

Preferably the diameter of the openings in jaw 16 are at least about 0.02 inch larger than the diameter of the arms 12 so that the jaw can be pivoted slightly in a longitudinal direction as illustrated in FIG. 4 and as explained in more detail hereafter.

Figure 3:
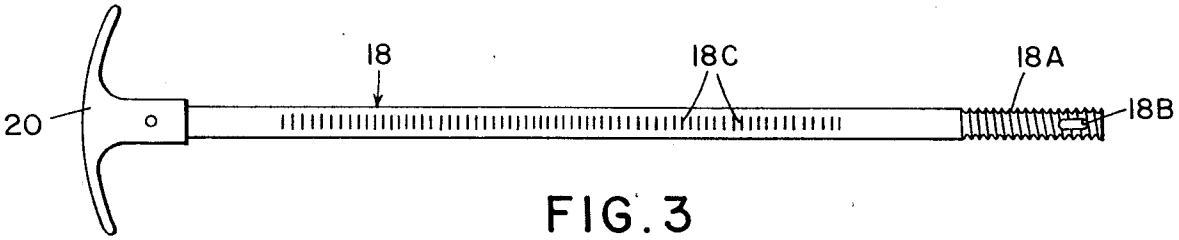
FIG. 3 is a top plan view of a preferred embodiment of pressure arm useful in the clamp of the invention.

Secured to base member 11 is a handle 26 for holding the clamp with one hand. An elongated pressure arm 18 extends horizontally through the base member and is attached at end 18A to mounting 17 on movable jaw 16 by means of pin 24. As shown in FIG. 3, the end 18A of arm 18 includes an enlongate aperture or slot 18B. End 18A is also threaded. Pin 24 passes through an opening in the mounting on the rear side of jaw 16 and also through the elongated slot 18B in arm 18. Threaded nut 22 is carried on end 18A of arm 18.

Arm 18 also includes notches or serrations 18C on its surface. These notches enable the arm 18 to be advanced through the base member by a ratcheting action. Movable lever arm 28 is pivotably mounted to the base by means of pin 29. Secured to the upper end of arm 28 is an advance lever 30 which is adapted to engage a notch on arm 18 and then urge the arm 18 forwardly in response to movement of lever arm 28 toward handle 26. Spring member 36 urges advance lever 30 back to its normal starting position when lever arm 28 is released.

Figure 5:
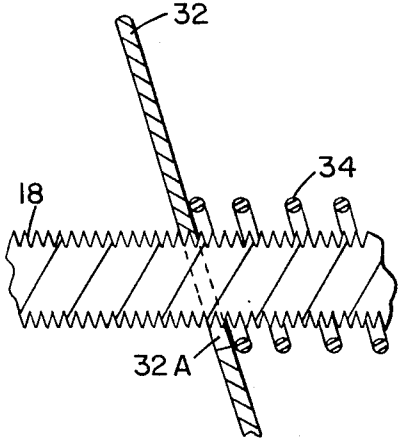
FIG. 5 is a cross-sectional view taken along line 5—5 in FIG. 2.

Pressure arm 18 also passes through an opening 32A in retention or catch lever 32. Spring member 34 urges lever 32 to its normal rearward position where the lever engages one of the notches in arm 18 and prevents the arm 18 from moving rearwardly. This is illustrated in FIG. 5.

When advance lever 30 urges the pressure arm 18 forwardly (i.e., to move jaw 16 toward jaw 14), the catch lever 32 allows the arm 18 to advance through opening 32A. Catch lever 32 always prevents the arm 18 from moving rearwardly, however, unless the operator pushes the upper end of lever 32 forwardly to disengage the lever from arm 18.

The handle 20 on the rearward end of arm 18 allows the operator to pull the pressure arm 18 rearwardly any desired distance while the upper end of lever 32 is pushed forwardly to disengage arm 18.

Thus, the clamp can be held and operated with one hand, thereby freeing the other hand to hold the objects to be clamped, for example. With one hand the operator is able to hold the clamp and also work lever 28 to cause the pressure arm 18 to advance jaw 16 toward stationary jaw 14 to clamp the objects. When the jaw 16 has been advanced in this manner it will become fairly firmly urged against the objects being clamped. In order to apply even more pressure against jaw 16 it is possible to tighten nut 22 against the rear side of jaw 16 (as illustrated in FIG. 4). This causes jaw 16 to pivot very slightly on arms 12 so as to be urged against the objects being clamped with additional force. This also serves as a lock to keep the clamp tight. This is illustrated with dotted lines 16A in FIG. 4. In order to loosen the clamp again the nut 22 is first loosened. Then lever 32 may be urged forwardly to allow arm 18 to be retracted.

Another embodiment of the invention is also illustrated in FIG. 4. There is shown an insert or adaptor 40 which is detachably mounted to the face of jaw 14. Adaptor 40 includes a post or shank 44 on its rear face which passes through an appropriate opening in jaw 14. A pin 45 is then passed through a transverse opening in shank 44 to retain the adaptor in position, as illustrated. A portion of jaw 14 is shown as a cut-away to show these features.

The front face of adaptor 40 is shown to include a curved recess 42 for facilitating the clamping of a curved object in the clamp between the jaws. For example, this type of adaptor is useful when using the clamp to hold cylindrical objects such as a pipe or a dowel rod, for example. Other types of adaptors may also be used, of course. When the adaptor is not used, preferably the opposing faces of the jaw are planar and parallel to each other.

The clamp of the invention can be made in any desired size and may be composed of any suitable material (e.g., metal), depending upon the intended use for the clamp. The length of the support arms 12 and the pressure arm 18 may also vary.

Preferably the support arms 12 are cylindrical, although they could have any desired cross-sectional configuration (e.g., square, rectangular, etc.).

What is claimed is:

1. A clamp operable with one hand, said clamp comprising:

(a) elongated support means having first and second ends; said support means comprising two spaced-apart, parallel, horizontal support arms;

(b) a base member secured to said first end of said support means;

(c) handle means carried by said base member, said handle means including a movable lever arm;

(d) a stationary jaw member secured to said second end of said support means and extending downwardly therefrom;

(e) a movable jaw member supported by said support means and being movable therealong; said movable jaw member extending downwardly from said support means and being pivotable with respect thereto;

(f) an elongated pressure arm having first and second ends, said second end being attached to said movable jaw member; wherein said pressure arm extends through said base member; and wherein said pressure arm is disposed below and parallel to said horizontal support arms;

(g) advance means carried by said base member and being operable by said lever arm; said advance means being adapted to advance said pressure arm through said base member in a manner such that said movable jaw member is advanced toward said stationary jaw member;

(h) releasable catch means carried by said base member for preventing rearward movement of said pressure arm; and (i) lock means carried on said second end of said pressure arm; wherein said lock means is adapted to pivot said movable jaw member relative to said support means so as to lock said movable jaw member in a fixed position.

2. A clamp in accordance with claim 1, wherein said pressure arm includes a plurality of spaced notches along its length; wherein said movable lever arm is movable between first and second positions; and wherein said lever arm is adapted to engage a said notch on said pressure arm and advance said pressure arm when said lever arm is moved from said first position to said second position.

3. A clamp in accordance with claim 2, further comprising bias means for biasing said lever arm to said first position.

4. A clamp in accordance with claim 2, wherein said catch means comprises a finger carried by said base member, said finger being adapted to engage a said notch in said pressure arm to prevent rearward movement of said pressure arm.

5. A clamp in accordance with claim 1, wherein said stationary jaw member and said movable jaw member include opposing parallel faces.

6. A clamp in accordance with claim 1, further comprising an adaptor detachably mounted to one of said jaw members, wherein said adaptor includes a recessed area for facilitating clamping of a curved object between said jaw members.

7. A clamp in accordance with claim 1, wherein said second end of said pressure arm is threaded, and wherein said lock means comprises a threaded nut carried on said second end of said pressure arm.

8. A clamp in accordance with claim 1, wherein said movable jaw includes openings therethrough through which said support arms extend; wherein said openings have a diameter at least about 0.02 inch larger than the diameter of said support arms to enable said movable jaw to pivot slightly toward said stationary jaw; wherein said second end of said pressure arm includes an elongated aperture; and wherein said movable jaw is connected to said second end of said pressure arm by means of a pin extending through said aperture.

9. A ratchet clamp operable with one hand, said clamp comprising:

(a) elongated support means having first and second ends; said support means comprising two spaced-apart, parallel, horizontal support arms;

(b) a base member secured to said first end of said support means;

(c) handle means carried by said base member, said handle means including a movable lever arm;

(d) a stationary jaw member secured to said second end of said support means and extending downwardly therefrom;

(e) a movable jaw member supported by said support means and being movable therealong; said movable jaw member extending downwardly from said support means and being pivotable with respect thereto;

(f) an elongated pressure arm having first and second ends, said second end being attached to said movable jaw member; wherein said pressure arm extends through said base member; and wherein said pressure arm is disposed below and parallel to said horizontal support arms;

(g) ratchet means carried by said base member and being operable by said lever arm; said ratchet means being adapted to advance said pressure arm through said base member in a manner such that said movable jaw member is advanced toward said stationary jaw member;

(h) releasable catch means carried by said base member for preventing rearward movement of said pressure arm; and (i) lock means carried on said second end of said pressure arm; wherein said lock means is adapted to pivot said movable jaw member relative to said support means so as to lock said movable jaw member in a fixed position.

10. A clamp in accordance with claim 9, wherein said pressure arm includes a plurality of spaced notches along its length; wherein said movable lever arm is movable between first and second positions; and wherein said lever arm is adapted to engage a said notch on said pressure arm and advance said pressure arm when said lever arm is moved from said first position to said second position; and further comprising bias means for biasing said lever arm to said first position.

11. A clamp in accordance with claim 10, wherein said catch means comprises a finger carried by said base member, said finger being adapted to engage a said notch in said pressure arm to prevent rearward movement of said pressure arm.

12. A clamp in accordance with claim 9, wherein said stationary jaw member and said movable jaw member include opposing parallel faces.

13. A clamp in accordance with claim 9, further comprising an adaptor detachably mounted to one of said jaw members, wherein said adaptor includes a recessed area for facilitating clamping of a curved object between said jaw members.

14. A clamp in accordance with claim 9, wherein said second end of said pressure arm is threaded, and wherein said lock means comprises a threaded nut carried on said second end of said pressure arm.

15. A clamp in accordance with claim 9, wherein said movable jaw includes openings therethrough through which said support arms extend; wherein said openings have a diameter at least about 0.02 inch larger than the diameter of said support arms to enable said movable jaw to pivot slightly toward said stationary jaw; wherein said second end of said pressure arm includes an elongated aperture; and wherein said movable jaw is connected to said second end of said pressure arm by means of a pin extending through said aperture.

* * * * *